United States Patent [19]

Levy

[11] 4,344,861

[45] Aug. 17, 1982

[54] BIS-AMIDES AS CORROSION INHIBITORS

[75] Inventor: Joseph Levy, Deerfield Beach, Fla.

[73] Assignee: UOP Inc., Des Plaines, Ill.

[21] Appl. No.: 112,364

[22] Filed: Jan. 15, 1980

[51] Int. Cl.[3] ..... C23F 11/12; C23F 11/14; C23F 11/16

[52] U.S. Cl. ..... 252/391; 106/14.18; 106/14.27; 106/14.31; 106/14.42; 208/47; 252/50; 252/8.55 E; 252/392; 422/7; 422/12; 422/16

[58] Field of Search ..... 252/391, 392, 8.55 E, 252/50; 208/47; 106/14.18, 14.27, 14.31, 14.42; 422/12, 16, 7

[56] References Cited

U.S. PATENT DOCUMENTS

| | | | |
|---|---|---|---|
| 2,939,842 | 6/1960 | Thompson | 106/14.18 |
| 3,907,578 | 9/1975 | Scherrer et al. | 106/14.18 |
| 3,962,122 | 6/1976 | Trial | 252/392 |
| 4,072,626 | 2/1978 | Finney | 252/392 |
| 4,130,524 | 12/1978 | Boerwinkle et al. | 252/392 |
| 4,131,583 | 12/1978 | Boerwinkle | 252/392 |

*Primary Examiner*—Benjamin R. Padgett
*Assistant Examiner*—Irwin Gluck
*Attorney, Agent, or Firm*—James R. Hoatson, Jr.; Raymond H. Nelson; William H. Page, II

[57] ABSTRACT

A method of inhibiting the corrosion of metals in contact with petroleum and petroleum fractions other than gasoline comprises contacting metal surfaces with a corrosion inhibiting amount of bis-amides resulting from reaction of one mole of amine with one equivalent of a dicarboxylic acid.

23 Claims, No Drawings

BIS-AMIDES AS CORROSION INHIBITORS

BACKGROUND OF THE INVENTION

Metal corrosion is a problem in the petroleum industry which persists from the well-head, through refining operations, and into storage of purified materials. Among the operations where corrosion is a constant menace to the structural integrity of equipment is production of petroleum at the well, secondary petroleum recovery through water flooding, storage and transportation of crude oil, refinery operations such as distillation, condensation, heating, catalytic cracking and reforming, and transportation and storage of refined petroleum products. The successful operation of many of these processes are dependent upon the use of corrosion inhibitors to minimize equipment replacement costs and lost time associated with necessary maintenance and repair.

There is no single causative factor in promoting metal corrosion, although the presence of water, even if only in relatively small quantities, is a common denominator. Perhaps the most pernicious material promoting corrosion is hydrogen sulfide. Whether present per se, or produced from organic sulfides in various refining operations, hydrogen sulfide may be present in petroleum and petroleum products from the well-head through the refinery. Another common source of corrosion is dissolved salt, i.e., brine, which is particularly acute at the well-head. Still another common source is dissolved oxygen. Other agents either normally present in petroleum, or produced during its processing, which contribute to corrosion are hydrogen chloride, carbon dioxide, and carboxylic acids. Additional factors to be considered are the acidity (pH) of the corrosive media and the temperature at which metal surfaces are exposed to corrosive media.

As there is no universal causative factor in promoting corrosion, so there is no universal panacea in inhibiting corrosion. Perhaps the single most important class of chemical agents useful as corrosion inhibitors to the petroleum industry is the class of organic nitrogen compounds. Examples include: N-alkyl propylenediamines, U.S. Pat. No. 2,736,658, and their salts with fatty acids; imidazolines and tetrahydropyrimidines, U.S. Pat.. No. 3,020,276; polyethoxylated amines and amides; and various succinic anhydrideamine condensation products, U.S. Pat. No. 3,347,645. Although great strides have been made in affording protection to metals against the corrosive agents encountered in the petroleum and related industries, there remains a need for corrosion inhibitors which will appreciably lengthen the lifetime of metallic components used in various operations and which will minimize down-time associated with remedying difficulties traceable to corrosion. It is of prime importance that such corrosion inhibitors remain cost-effective while displaying superior inhibitory properties.

SUMMARY OF THE INVENTION

An object of this invention is to provide material which will inhibit the corrosion of metals in contact with petroleum and petroleum fractions. One embodiment of this invention comprises contacting metal surfaces with a corrosion inhibiting amount of the reaction product of one mole amine with one equivalent of a dicarboxylic acid. In a more specific embodiment, the reaction product results from one mole of a primary alkyl amine with one equivalent of a dimer acid. In another embodiment the amine is an N-alkyl propylenediamine and the acid is a dimer acid. In still another embodiment of this invention the amine is a mixture of two amines so as to form as a reaction product a mixture containing both the symmetrical and the unsymmetrical bis-amide.

DESCRIPTION OF THE INVENTION

Metal corrosion in the petroleum industry is a problem persisting in all phases of production and processing which begs for a solution. Such corrosion leads not only to replacement costs, but also down-time costs arising from the interruption of otherwise continuous processes. To be an effective corrosion inhibitor, the material should be available from cheap, plentiful raw materials, should be oil soluble, and low in cost. A discovery of this invention is that the reaction products, which comprise bis-amides, of one mole of amine with one equivalent of a dicarboxylic acid are such effective inhibitors.

The amines which can be used in this invention generally are primary amines and may be monoamines, diamines, and other polyamines. The reaction products of this invention are the bis-amides resulting from the reaction of each carboxyl group of a dicarboxylic acid with a primary amino group. Therefore, the term "bis-amides" includes bis-aminoamides, which result when the amine is a diamine or other polyamine. Monoamines which may be utilized are alkyl amines containing from 2 to about 40 carbon atoms, but preferably from about 5 to about 25 carbon atoms. Examples of suitable alkyl groups include ethyl, propyl, butyl, pentyl, hexyl, hectyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, and pentacosyl. Normally the alkyl group is linear; however, branched alkyl groups also may be used but not necessarily with equivalent results. The alkyl group may be either saturated or unsaturated, i.e., the carbonaceous portion may contain one or more olefinic bonds. The aforementioned alkyl groups commonly have their commercial origin in fatty acids, and consequently often are supplied as mixtures. Therefore it is to be understood that amines containing a combination of the aforementioned groups are explicitly within the scope of this invention. It also is contemplated that alkyl groups which are substituted with an hydroxy or alkoxy group are also within the scope of this invention. Alkoxyalkylamines, where the alkoxy portion contains from about 5 to about 18 carbon atoms, may be effectively employed as amines of this invention.

Cycloalkylamines also may be suitable in this invention where the cycloalkyl ring contains from about 5 to about 10 carbon atoms and cycloalkyl groups containing 5, 6, or 8 carbon atoms are preferred. Examples of such groups include cyclopentyl, cyclohexyl, cycloheptyl, cyclooctyl, cyclononyl, and cyclodecyl. The ring portion of such groups may also contain other alkyl, alkenyl, hydroxyl, and alkoxyl moieties, or any combination of these moieties.

Heterocyclic amines often afford products which are effective corrosion inhibitors; however, it is noteworthy that these heterocyclic amines are not primary amines. Examples of suitable heterocyclic amines, enumerated solely for purposes of illustration and not by way of limitation, are phenothiazine and morpholine.

Another class of amines used in this invention are diamines containing one primary amino group. When diamines are used, the products of reaction comprise bis-aminoamides. The diamines of this invention are alkylenediamines, wherein the alkylene group consists from 2 to about 10 carbon atoms. Examples of suitable diamines include ethylenediamine, propylenediamine, butylenediamine, pentylenediamine, hexylenediamine, etc. Especially desirable are propylenediamines. The diamines of this invention are substituted at one nitrogen atom with an alkyl, alkenyl, or cycloalkyl group, or substituted alkyl, alkenyl, or cycloalkyl group wherein these groups conform to the description given above.

Terminally N-substituted polyamines also are contemplated as being within the scope of this invention. Such polyamines include diethylenetriamine, triethylenetetramine, tetraelhylenepentamine, pentaethylenehexamine, etc. The terminal substituents may be an alkyl, alkenyl, or cycloalkyl group, or substituted alkyl, alkenyl, or cycloalkyl group wherein these groups conform to the description previously given.

Among the diacids which may be used are alkylene dicarboxylic acids containing from 2 to about 12 carbon atoms. It is also contemplated within the scope of this invention that aromatic dicarboxylic acids, such as phthalic acid, also may be used. Examples of alkylene dicarboxylic acids include oxalic acid, malonic acid, succinic acid, glutaric acid, adipic acid, pimelic acid, suberic acid, azaleic acid, sebacic acid, etc. Such dicarboxylic acids may also be substituted by an alkyl, an alkenyl, a cycloalkyl, an hydroxyl, or alkoxyl group as was heretofore described.

An especially desirable group of acids is that called dimer acids in the trade. Such acids result from dimerization of unsaturated fatty acids. See "The Dimer Acids," Edited by Edward C. Leonard (1975). These acids generally are tetrasubstituted cyclohexenes bearing two carboxylic acid groups. Of particular interest are those dimer acids which are produced by dimerizing fatty acids of 18 carbon atoms. It is to be understood that such dimer acids generally are available as a mixture, both in the context of containing monomer, dimer, and trimer, and also as to the carbon number of the fatty acid reactants. Consequently the reaction products of this invention include those with each of the aforementioned components.

The reaction products of this invention may be prepared by reacting one molar proportion of amine with one equivalent of a dicarboxylic acid under reaction conditions for a time sufficient to produce one molar proportion of water. By "one equivalent of a dicarboxylic acid" is meant that amount of acid which will furnish the same number of carboxyl groups as the number of primary amino groups contained in one molar proportion of amine. A solvent is employed advantageously and should be high boiling (100°–200° C.), inert, and should form an azeotrope with water. Aromatic solvents are especially convenient, and examples of these include toluene, xylene, tri-methylbenzenes, and so forth. The volume of solvent used approximates the sum of the weight of amine and acid employed. The mixture is then heated so as to distill the azeotrope of the solvent and water, most advantageously returning the solvent to the reaction mixture. The condensate is collected and heating is continued until the theoretical amount of water has been collected. It is to be noted that the proportion of reactants used is about one mole of amine per one equivalent (one-half mole) of acid. Therefore, one mole of water will be collected per mole amine employed. To accelerate formation of the reaction product, a small amount of a strong acid may be used as a catalyst. For example, p-toluenesulfonic acid at a concentration from about 1 to about 10 mole percent may be employed advantageously. A particular advantage of this invention is that the reaction mixture may be used in toto, without any separation or purification.

It is believed that the major product of the reaction is a bis-amide, although when ethylenediamines and propylenediamines are used imidazoles and tetrahydropyrimidines also may be formed. Such bis-amides are symmetrical when a single amine is used as the reactant. Mixtures of symmetrical and unsymmetrical bis-amides may be formed, at least in part, when a mixture of 2 amines is used. For example, an equimolar mixture of N-oleyl-1,3-propylenediamine and N-tallow-1,3-propylenediamine with a dicarboxylic acid will afford a mixture comprising the symmetrical N-oleyl bis-aminoamide, the symmetrical N-tallow bis-aminoamide, and the unsymmetrical N-oleyl-N'-tallow bis-aminoamide. Such unsymmetrical bis-amides may have particularly desirable anti-corrosion properties. Therefore, it is to be understood explicitly that the reaction product from a combination of amines in a total ratio of one mole with one equivalent of dicarboxylic acid is within the scope of this invention.

The amount of the bis-amides of this invention necessary to inhibit corrosion will depend on the nature of the bis-amide, the type of usage contemplated, and the identity and quantity of corrosive agents present in the petroleum or petroleum product contacting metal surfaces. For example, in protecting materials of construction in oil wells, concentrations of bis-amides from about 1 to about 1000 ppm, based on well liquids, may be beneficial. Preferably, a preliminary period of at higher concentrations, from about 5 to about 50 times the required steady state concentration, should be employed for several days at the beginning of the treatment.

In protecting refinery equipment, for example, condensers and fractionating columns, the bis-amides may be used in concentrations from about 1 to about 100 ppm, but generally from about 5 to about 50 ppm. To prevent corrosion of condensers, for example, the bis-amides may be injected as a solution in a suitable solvent at a point above that where condensation occurs. The non-volatile inhibitor then will run down the condenser, thereby protecting the metal surfaces from the action of corrosive agents. A preliminary treatment from about 5 to about 50 times the steady state concentration for several days is desirable for optimum protection.

Protection of metal surfaces in storage tanks may be obtained by applying a solution of bis-amides to such surfaces. Application may be by brushing, by spraying, or simply by introduction as a fog into the vapor space. The solution in kerosene, for example, may contain from 10% to 50% or more bis-amides, and may be applied in an amount equal to about 1 gallon solution per 500 to about 5000 square feet of metal surface to be protected.

The following examples are merely illustrative of this invention, and it is to be understood that the invention is not necessarily limited thereby.

EXAMPLE 1

A 500 ml. flask was fitted with a magnetic stirring bar and a reflux condenser attached to a Dean-Stark trap so that the pure xylene condensate would automatically be returned to the reaction flask. The flask was charged with 33.6 g N-oleyl-1,3-propylenediamine (0.1 mole), 28.5 g dimer acid (0.05 mole), obtained from Emery Industries as Empol 1018 (83% dimer, 17% trimer, and 2% monomer of 18 carbon atoms), and 60 g xylene. The mixture was heated to reflux with stirring until 2.1 ml. of water was collected in the Dean-Stark trap. Total reaction time was about 7 hours. The reaction mixture was a clear, light yellow solution, and was stored and tested for activity without further treatment. Its total weight was 120 g and therefore consisted of a 50% solution of bis-amide.

EXAMPLE 2

In a manner similar to that described in Example 1, an unsymmetrical bis-amide may be made by heating 24.5 g phenothiazine (0.25 mole), 42 g N-oleyl-1,3-propylenediamine (0.25 mole), 71.2 g dimer acid, Empol 1018 (0.25 mole), and 0.5 g p-toluenesulfonic acid, and 138 ml. xylene. The total reaction time necessary to collect a theoretical amount of water was about 5 hours.

EXAMPLE 3

Materials were tested for anti-corrosion properties by NACE standard tests TM-01-72. This test, prepared by the National Association of Corrosion Engineers, is a modification of ASTM D-665. The method involves stirring a mixture of a petroleum product containing dissolved inhibitor with distilled water at 38° C. for a definite time with a cylindrical steel specimen immersed in the solution. The test surface is then examined for rust. Experience has shown, according to NACE, that enough inhibitor present to produce B+ or B++ results by this test will control corrosion. The corrosion inhibiting properties of some of the products of this invention are summarized in the following table. In all examples listed therein inhibition was tested at a concentration equivalent to 8 pounds inhibitor per 1000 barrels petroleum, or about 33 ppm. Isooctane was used as the petroleum product.

CORROSION INHIBITING PROPERTIES OF BIS-AMIDES

| Amine | Acid | Rating |
|---|---|---|
| $C_{13}H_{25}O(CH_2)_3NH(CH_2)_3NH_2$ | Dimer[a] | B+ |
| N-oleyl-1,3-propylenediamine | Dimer[a] | B+ |
| N-tallow-1,3-propylenediamine | Dimer[a] | B++ |
| N-oleyl-1,3-propylenediamine | Dimer[b] | B+ |

[a]Contains about 83% dimer, 17% trimer, and 2% monomeric acids of 18 carbon atoms.
[b]Contains about 75% dimer and 25% trimer acids from monocarboxylic acid of 18 carbon atoms.

I claim:

1. A method of inhibiting corrosion of metals in contact with petroleum and petroleum fractions other than gasoline comprising contacting surfaces of said metals with a corrosion inhibiting amount of a corrosion inhibitor consisting of the reaction product of about one mole ratio of an amine with about one equivalent of a dicarboxylic acid.

2. The method of claim 1 wherein said amine is selected from the group consisting of alkyl and alkenyl monoamines containing from about 5 to about 25 carbon atoms.

3. The method of claim 2 wherein said amine bears a substituent selected from the group consisting of hydroxy and alkoxy moieties.

4. The method of claim 1 wherein said amine is a cycloalkyl monoamine, wherein said cycloalkyl group contains from about 5 to about 10 carbon atoms.

5. The method of claim 1 wherein said amine is phenothiazene.

6. The method of claim 1 wherein said amine is selected from the group consisting of alkyl and alkenyl alkylenediamines, wherein said alkylene diamine contains from 2 to about 10 carbon atoms, and said alkyl and alkenyl moieties contain from about 5 to about 25 carbon atoms.

7. The method of claim 6 wherein said alkyl group bears a substituent selected from the group consisting of hydroxyl and alkoxyl moieties.

8. The method of claim 1 wherein said dicarboxylic acid is an alkylene dicarboxylic acid containing from 2 to about 12 carbon atoms.

9. The method of claim 8 wherein said alkylene group bears a moiety selected from the group consisting of alkyl and alkenyl moieties containing from 1 to about 10 carbon atoms.

10. The method of claim 8 wherein said dicarboxylic acid is the dimer of an unsaturated monocarboxylic fatty acid containing from about 16 to about 20 carbon atoms.

11. The method of claim 1 wherein said amine is selected from the group consisting of oleylamine, N-oleyl-1,3-propylenediamine, tallow amine, and N-tallow-1,3-propylenediamine and said carboxylic acid is the dimer of an unsaturated monocarboxylic fatty acid containing 18 carbon atoms.

12. The method of claim 1 wherein said amine is a mixture consisting of at least 2 amines.

13. A composition comprising a major amount of a hydrocarbonaceous material other than gasoline and a minor amount, sufficient to impart corrosion inhibiting properties, of a corrosion inhibitor consisting of the reaction product of one mole of an amine with one equivalent of a dicarboxylic acid.

14. The composition of claim 13 wherein said amine is selected from the group consisting of alkyl and alkenyl monoamines containing from about 5 to about 25 carbon atoms.

15. The composition of claim 14 wherein said amine bears a substituent selected from the group consisting of hydroxy and alkoxy moieties.

16. The composition of claim 13 wherein said amine is a cycloalkyl monoamine wherein said cycloalkyl group contains from about 5 to about 10 carbon atoms.

17. The composition of claim 13 wherein said amine is phenothiazine.

18. The composition of claim 13 wherein said amine is selected from the group consisting of alkyl and alkenyl alkylenediamines, wherein said alkylene diamine contains from 2 to about 10 carbon atoms, and said alkyl and alkenyl moieties contain from about 5 to about 25 carbon atoms.

19. The composition of claim 18 wherein said alkyl group bears a substituent selected from the group consisting of hydroxyl and alkoxyl moieties.

20. The composition of claim 13 wherein said dicarboxylic acid is an alkylene dicarboxylic acid containing from 2 to about 12 carbon atoms.

21. The composition of claim 20 wherein said alkylene group bears a moiety selected from the group consisting of alkyl and alkenyl moieties containing from 1 to about 10 carbon atoms.

22. The composition of claim 20 wherein said dicarboxylic acid is the dimer of an unsaturated monocarboxylic fatty acid containing from about 16 to about 20 carbon atoms.

23. The composition of claim 13 wherein said amine is selected from the group consisting of oleylamine, N-oleyl-1,3-propylenediamine, tallow amine, and N-tallow-1,3-propylenediamine and said dicarboxylic acid is the dimer of an unsaturated monocarboxylic fatty acid containing 18 carbon atoms.

* * * * *